US007802985B2

(12) United States Patent
Cross

(10) Patent No.: US 7,802,985 B2
(45) Date of Patent: Sep. 28, 2010

(54) DIRECT FIRED HEATER UTILIZING PARTICULATES AS A HEAT TRANSFER MEDIUM

(76) Inventor: Alan Cross, 73-34 244th St., Little Neck, NY (US) 11362

( * ) Notice: Subject to any disclaimer, the term of this patent is extended or adjusted under 35 U.S.C. 154(b) by 45 days.

(21) Appl. No.: 11/977,297

(22) Filed: Oct. 25, 2007

(65) Prior Publication Data

US 2009/0107422 A1 Apr. 30, 2009

(51) Int. Cl.
*F24H 1/00* (2006.01)

(52) U.S. Cl. ..... 432/219; 432/222; 110/261

(58) Field of Classification Search ..... 122/1 R, 122/7 R; 165/134.1; 432/219, 222
See application file for complete search history.

(56) References Cited

U.S. PATENT DOCUMENTS 4,960,502 A * 10/1990 Holland ..... 208/85
5,031,692 A * 7/1991 Kehrer et al. ..... 165/134.1
5,464,057 A * 11/1995 Albano et al. ..... 165/173
5,813,453 A * 9/1998 Brucher ..... 165/134.1
5,816,322 A * 10/1998 Albano et al. ..... 165/173
7,476,364 B2 * 1/2009 Peng et al. ..... 422/168

* cited by examiner

*Primary Examiner*—Gregory A Wilson

(57) ABSTRACT

This invention relates to a means of heating a process fluid to elevated temperature thru use of heat resistant particulates as a heat transfer medium. Down-ward flowing particulates, enter the top of a refractory lined containment vessel, and are heated to elevated temperature by direct contact with an up-flowing stream of hot combustion products, generated by side wall burners located at the bottom of the containment vessel. The heated particulate stream is separated from the combustion gas stream at the bottom of the containment vessel and the spent combustion gas is directed to a downstream tubular convection section for heat recovery and for further processing to recover vaporized process fluid, as in the case of liquid feed preheating for delayed coking, or for heat recovery only, as in the case of gas cracking. The particulate stream is conveyed to the bottom of a second refractory lined containment vessel, by means of an incoming stream of process fluid, and is raised to the desired outlet temperature by direct contact with the particulate stream. The particulates are separated from the process fluid in a low velocity region located in an expanded section at the top of the second vessel, and the process fluid is processed further in downstream equipment. Spent particulates are returned to the top of the first vessel, completing a continuous cycle.

3 Claims, 2 Drawing Sheets

DIRECT FIRED HEATER UTILIZING PARTICULATES AS A HEAT TRANSFER MEDIUM

BACKGROUND OF THE INVENTION

Direct fired heaters find wide application, particularly in oil refineries, where they are used for the purpose of preheating petroleum or petroleum derived feed-stocks for further processing to produce such products as fuel gas, gasoline, diesel fuel, heavy fuel oil and coke. The feed-stocks are of variable composition and boiling range and require that they be preheated to varying temperatures for further processing. Some of the applications considered would be as follows:

Delayed Coking Heater Service, which is the primary focus of the subject invention, and which involves preheating of high boiling point feed-stocks, such as residua, to high temperature, and transferring the heater effluent to a coke drum where it is held for a period of time, sufficient, to convert the feed-stock charged to a product slate consisting of fuel gas, low boiling point liquids, high boiling point liquids and coke.

Direct fired heaters in this service operate at the severest conditions of any in common oil refinery service, with the exception of direct fired heaters in thermal cracking service. Thus the design strategies applicable to heaters in delayed coking service should, in principle, be applicable to other services as well, these to include:

Crude Heater Service, wherein pretreated as-received crude is pre-heated to high, but somewhat lower temperature than that used in delayed coking, prior to being introduced to an atmospheric distillation column, where a large spectrum of products are separated from one another, to yield such end products as refinery gas, gasoline, diesel fuel, heavy fuel oil, and very high boiling point residua.

Vacuum Heater Service, wherein residual feed-stocks from atmospheric distillation are preheated to high temperature, under vacuum, followed by processing in a vacuum distillation column, to separate such products from the heater effluent as gas, liquids with a wide range of boiling points and a very high boiling residuum suitable for use as a delayed coking feedstock.

Cracking Heater Service, wherein a low molecular weight hydrocarbon gases or moderate molecular weight vaporized hydrocarbon liquids, in the presence of steam, is converted to a gaseous product containing unsaturated hydrocarbon gases, such as ethylene, propylene, and other products consisting of higher molecular weight hydrocarbons. Optimum conversion is obtained by heating the steam-hydrocarbon mixtures to elevated temperature in a short residence time conventional heater, designed to provide a residence time of less than one second. Comparable operating conditions are obtainable in a heater designed in accordance with the subject invention and comprise another focus of the invention.

Conventional direct fired heaters used for the above services are usually provided with two sections, a radiant section and a convection section. The radiant section consists of a refractory lined enclosure having one or more tubular heating coils, thru which the process fluid flows. The heating coils surround a grouping of one or more burners fueled by gas, oil or other combustible. The heating coils are arranged to form a combustion chamber into which high temperature combustion products, generated by the burners, are discharged. Heat is transferred from the combustion products to the heating coils and contained process fluid, principally by radiation.

Process fluid, and/or fluid preheating for other services is usually conducted in the convection section, prior to further post-heating of the convection section streams in the radiant section or elsewhere. The convection section consists of a refractory lined enclosure containing multiple rows of closely spaced tubes, the spaces between tubes, forming multiple channels thru which flow relatively low temperature combustion products, exiting the radiant section. The combination of high velocity combustion gas flow, the low temperature of the combustion products and the relatively small radiating volume of the combustion gases result in predominately convective transfer of heat from combustion products to process fluid.

Because of the high temperature to which hydrocarbon fluids processed in the radiant section are subjected, fluids at the inside wall of the tubular radiant section heating elements experience thermal decomposition, which results in internal coke deposition, the thickness of the deposits being greatest at locations where tube metal temperatures are highest. These deposits restrict the flow of heat from the tube wall to the contained process fluid so that the tube wall temperature eventually reaches design temperature. At this point, referred to as end of run conditions, the heater must be shut down or on-stream decoking procedures initiated, to avoid tube damage. The time interval between decoking procedures is referred to as run length. Since decoking involves use of additional labor and, utilities and incurs costs due to lost production, means of eliminating or minimizing the frequency of decoking is a worthwhile pursuit.

In the case of the subject invention, used in cracking heater service, extended run lengths are obtainable without the need for heater shut down for periodic removal of tubular coke deposits, as in the case of conventional heaters. Coke instead deposits on the surfaces of the particulates used as a heat transfer medium. Such deposits are removable while the heater is in operation by adding appropriate quantities of air to the burner flue gas effluent in the vessel used for particulate preheating prior to transferring the particulates to the vessel used for feed preheating and cracking.

SUMMARY OF THE INVENTION

This invention relates to the design of a novel direct fired heater using solid particulates as a heat transfer medium, the heater consisting of two vessels, one vessel for heating a particulate stream to elevated temperature and a second vessel for heating a process feed stream to design outlet temperature with heated particulates. The first vessel consists of a refractory lined, vertical cylindrical, water jacketed containment vessel wherein metallic particulates are directed downwards by a dispersion device, the dispersion device being located at the top of the vessel, so as to directly contact a stream of upward flowing hot combustion products generated by several burners located at the bottom of the vessel, the burners being fired by gaseous, liquid or other types of fuel. After heat exchange between the hot combustion gas and particulate streams, the combustion gas stream is separated from the particulate stream, and the hot particulate stream is collected and contained in a conical cavity at the bottom of the vessel. The combustion gas stream exits at the top of the vessel, passes through a refractory lined, horizontal tube convection section, for heat recovery, and preheats a stream of incoming process fluid feed-stock in the process. A transfer line directs the preheated process fluid inlet stream to the bottom outlet of the first vessel, where it encounters and mixes with particulates, extracted from the bottom of vessel by a standpipe. Particulates and preheated process fluid feed are conveyed to a second vertical cylindrical refractory lined vessel wherein heat is exchanged between particulate and process feed streams, the feed stream being raised to design outlet temperature in the process. When the process fluid is a liquid, as in delayed coking service, a settling chamber, consisting of an enlarged section of the second vessel, allows for separation of spent particulates, process fluid vapor, and process fluid at design temperature, the liquid process fluid being transferred to downstream equipment for further processing, and vaporized process fluid being transferred to the inlet of a convection section, there joining a stream of combustion products and process fluid vapor, originating from particulates from the second vessel which enter the first vessel. Particulates coated with a thin film of process fluid, are collected at the base of the settling chamber and are transferred from the bottom of the settling chamber to a dispersion device in the first vessel, completing the flow sequence. When the process fluid is a gas or vapor, as in gas cracking, the settling chamber is used only to separate the process stream from the particulates, the processing stream being transferred to downstream equipment for further processing.

A third vessel, termed a quench tower, utilizes a stream of liquid particulates as a heat and mass transfer medium. The quench tower is meant for use, in conjunction with the direct fired particulate heater in liquid processing heating services, for the purpose of recovering process fluid vapors from the combustion product stream exiting the convection section of the first heat transfer vessel.

The quench tower consists of a single, vertical cylindrical, refractory lined vessel, the purpose of which is to cool the combustion product gas stream, which contains a significant quantity of process fluid vapor. When cooled to a lower temperature the process vapors are condensed, recovered, recycled, and added to the incoming process fluid stream entering the convection section tube array. The tower has a top outlet, a top particulate water generating module and a bottom inlet and bottom liquid particulate receiving module. The water generating module consists of a multiplicity of small diameter tubes, uniformly spaced on triangular or quadrilateral centers, the tubes being surrounded by a reservoir of water, contained in a cavity surrounding the tubes. Water overflowing the tops of the tubes leaves the tubes as particulates, through ports located at the bottom of the tubes, and is carried downward by jets of dispersion gas. Combustion product gas leaves the vessel at a nozzle centered between an upper and lower plate to which the particulate generating tubes are connected, after first passing thru ports in the lower plate having openings of the same size and arrangement as those for the particulate generating tubes. The lower particulate receiving module is an inverted version of the top particulate generating module, and consists of a multiplicity of non-ported tubes and combustion product inlet gas ports, the tubes and ports having the same size and arrangement as those in the upper module. Incoming combustion product gas, laden with process feed fluid vapor, leaves the convection section outlet of the direct fired particulate heater, enters through an inlet nozzle centered between the upper and lower plates of the lower module, and exits as multiple upward flowing jets through inlet ports in the upper plate of the module, the combustion product gas jets flowing counter to the downward flowing particulate jets. A multiplicity of inlet module tubes conduct particulates to the lower conical receiving cavity of the containment vessel, the particulate stream coalescing to form three layers, a condensed liquid process feed stream layer, a water layer and a dispersion gas layer. The water layer is withdrawn through an outlet nozzle, and is cooled to a temperature for quench tower re-use, in a cooling tower of conventional design. The process feed layer is withdrawn through a nozzle and combined with the incoming process fluid stream entering the fired particulate heater convection section and the atomizing gas layer is withdrawn through a nozzle for reuse in the upper particulate generating module.

When the process fluid is a gas, as in gas cracking, the quench tower is dispensed with and the settling chamber need only separate the cracked process gas stream from the particulates, the cracked gas being transferred downstream for separation of the cracked product constituents from the heater effluent.

BRIEF DESCRIPTION OF THE DRAWINGS

One embodiment of the invention, a direct fired particulate process heater, using particulates as a heat transfer medium, is shown in FIG. 1, and several views thereof, and consists of a longitudinal section, as viewed from a vertical plane passing through the center line of a containment vessel, designated containment vessel 1. Disposed within the containment vessel is a tubular particulate dispersion device, located at the top of the vessel, the particulates in the dispersion device being pressurized for dispersion by means of a helical conveyor, the conveyor being located at the inlet end of the dispersion device. Dispersion of the particulates in the form of one or more conical jets is accomplished through use of high pressure steam jets which pass through ported openings in the dispersion device, and allow for contact between the steam jets and the mass of solids carried by the device.

Burners located at the bottom of the vessel are provided for atmospheric combustion product generation, combustion products heating particulates to high temperature by direct heat exchange with the particulates. A horizontal tube convection section accepts the flow of combustion products discharged from the top, side outlet of containment vessel 1, and in so doing preheats incoming process fluid contained, in the tubular elements of the convection section. A standpipe, located at the bottom of the vessel, allows particulates to exit the vessel and mix with pressurized process feed fluid. After mixing with high temperature particulates, the preheated process fluid conveys the process fluid-particulate mixture to a vessel designated containment vessel 2, and is, there, further heated to design outlet temperature.

Section L-L is an arrangement as viewed from a horizontal plane, perpendicular to the vertical center lines of containment vessels 1 and 2, and provides a plan view of the vessels and the particulate dispersion device of vessel 1. Process fluid feed, preheated in the convection section, is brought to design temperature in vessel 2, by direct heat exchange with heated particulates from vessel 1.

DETAILED DESCRIPTION OF THE INVENTION

Figures 1, 2:
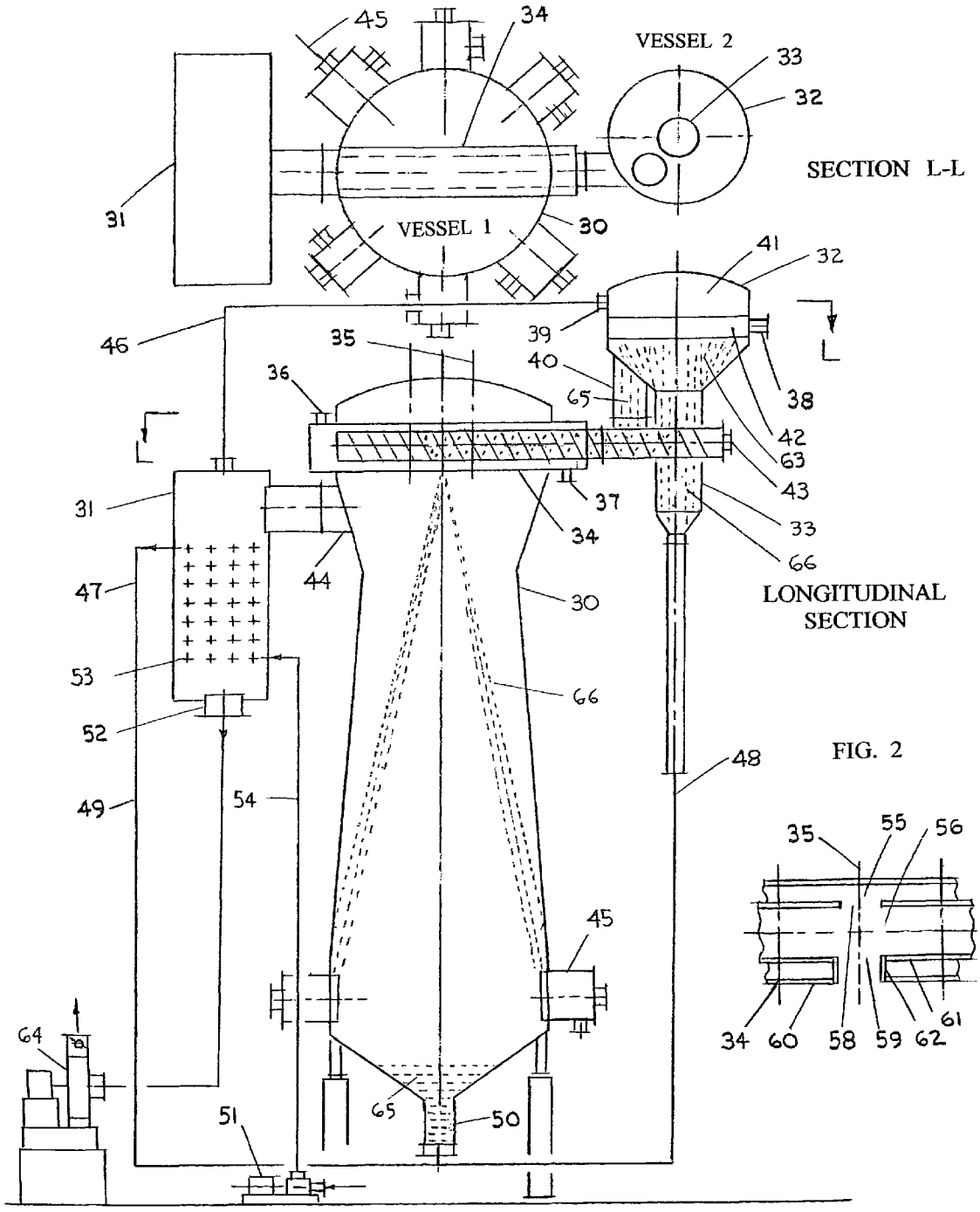
FIG. 2, is a partial longitudinal section through the particulate feed dispersion device, showing outer steam and inner particulate containment tubes. Steam flowing through the annular space between tubes serves as a cooling medium, preventing overheating and surface coking of particulates exiting containment vessel 2, inasmuch as particulates exiting vessel 2, are coated with process fluid. One or more ports centered on vertical or angled centerlines distributed along the length of both tubes, allow pressurized steam to entrain and eject particulates downwards for direct contact with upward flowing combustion products contained in vessel 1. Another embodiment of the invention, a quench tower, using liquid particulates as a heat and mass transfer medium, is shown in FIG. 3, and several views thereof, and consists of an internally insulated containment vessel, as viewed from a vertical plane passing through the centerline of the vessel. Disposed within the vessel is an upper, ported, tubular particulate generating module, provided with combustion product exit ports and a lower unported tubular particulate exit module provided with combustion product entry ports. Tubes are arranged, in both upper and lower modules, as shown in Section Y-Y and FIG. 4, the upper module providing for down-flowing jets of dispersion gas and particulates, the dispersion gas assisting in particulate generation, and the lower module providing up-flowing jets of combustion product gas, the combustion product gas entering the module thru an inlet nozzle connected to a transfer line carrying combustion product gas exiting the convection section of containment vessel 1 of FIG. 1. Due to the sizing, orientation, and choice of combustion and dispersion gas flow-rates, adjacent up-flow and down-flow jets diverge but slightly, as do particulate streams carried by the down-flowing jets. The lack of divergence contributes to vertical parallel particulate flow and highly effective contact between particulates and combustion product gas.

One embodiment of the invention, a direct fired heater, using heat resistant particulates as a heat transfer medium, is shown in FIGS. 1 and 2, and consists of component parts as follows:

In the case of liquid feed and gaseous feed processing, an external water jacketed and internally insulated vertical cylindrical containment vessel, item 30, designated containment vessel 1, is provided, the vessel having sloping sidewalls, conforming to the configuration of the particulate-steam jets discharged from the particulate distribution and dispersion device, the particulates being heated to high temperature by direct contact and heat exchange with high temperature combustion products. A down-flow tubular convection section, item 31, accepting combustion product gas discharged from the top sidewall outlet of containment vessel 1, item 44, allows combustion product gas to flow downward across the outer surfaces of the tubular elements, item 53, and in so doing exits the convection section at a temperature above the dew-point of the process fluid vapor carried by the combustion products. In the process of flue gas cooling, incoming process fluid is preheated at the inside surfaces of the tubular elements, item 53. A settling chamber, item 32, consisting of a vertical cylindrical section of large diameter, located immediately above containment vessel 2, item 33, allows for separation of spent particulates, process fluid liquid and process fluid vapor. In the case of gaseous feed processing and the absence of a liquid phase, the settling chamber need only separate the particulates from the gaseous heater effluent of containment vessel 2, the fluid layer, item 42, being nonexistent. The vertical cylindrical containment vessel, designated containment vessel 2, is a vessel wherein preheated process fluid is raised to design outlet temperature by direct contact and heat exchange with particulates at high temperature exiting containment vessel 1 through a standpipe, item 50. Flow of particulates thru vessels 1 and 2 and their component parts is as shown by items 65 and 66. An externally insulated outer tube, item 34, and item 60, FIG. 2, surrounding an axially located inner tube, item 61, FIG. 2, is provided, the inner tube conveying particulates, pressurized by a helical conveyor, item 43, located at one end of the inner tube. Both tubes have upper and lower ports located at one or more points along the length of the tubes and are designed so as to allow pressurized steam, flowing through the annular space between inner and outer tubes, to contact and entrain particulates contained in the inner tube, thereby directing particulates and steam downward, in the form of jets, The ports are vertically or angularly arranged, with vertical centerlines as indicated by items 35, the ports allowing for direct contact between down-flowing particulates and up-flowing high temperature combustion products. Nozzles 36. and 37 allow high pressure steam to enter at one and exit at the opposite end, respectively, of the outer tube, item 34. Downstream exit nozzle, item 38 provides for transfer of process fluid at design temperature to downstream processing equipment. In the case of liquid fluid processing, a side outlet nozzle, item 39, is provided which allows process fluid outlet vapor, conveyed by transfer line, item 46, to enter the top of the convection section, item 31. In the case of gaseous feed processing, items 39 and 46 are not needed nor provided. Vertical, spent particulate transfer line, item 40, conveys particulates to the inlet end of helical conveyor, item 43. Upper settling chamber process vapor cavity, item 41, collects vaporized liquid in the case of liquid feed processing, for transfer of said vaporized liquid to the top inlet of the convection section, item 31. Upper settling chamber process feed liquid layer, item 42, in the case of liquid feed processing, exits nozzle, item 38 for further down-stream processing, as does product gas in the case of gaseous feed processing. Spent particulates are pressurized by means of rotary particulate conveyor, item 43, for transfer to the particulate ejection ports located at the centerlines defined by items 35. Centerlines of multiple, horizontal, air-fuel premix burners, items 45, located in the lower sidewalls of containment vessel 1, fire gaseous fuel, liquid fuel or fuels of other types, so as to generate high temperature combustion products, directed upwards, Particulates directed downwards, are thereby preheated to high temperature, by direct contact and heat exchange. Convection section transfer line, item 49, transfers preheated process feed from convection section preheated process feed outlet tubes, to outlet of standpipe, located at the bottom of containment vessel 1. Preheated process feed transfer line, item 48, transfers particulates and preheated feed from outlet of standpipe to bottom of containment vessel 2, item 33. Incoming process fluid feed charge pump, item 51, pressurizes incoming feed and transfers said feed by means of transfer line, item 54, to bottom inlet convection section tubes, items 53. In the case of liquid fluid processing, as in feed preheating for delayed coking heater service, convection section combustion product gas and process fluid vapor outlet nozzle, item 52, transfers combustion product gas and process fluid vapor to the quench tower inlet, by means of an induced draft fan with damper, item 64. In the case of gaseous fluid processing, as in gas cracking heater service, convection section outlet, item 52 only functions to vent combustion product gas to atmosphere, by means of induced draft fan with damper, item 64. In the case of liquid processing as in delayed coking service, annular space, item 55, FIG. 2, between outer and inner tubes of particulate dispersion and distribution device, provides for a flow of pressurized cooling steam to prevent coking of process fluid contained on the outside surfaces of particulates entering the dispersion device from vessel 2. Steam also enters ports at the top of the inner tube, item 58, the resulting steam flow contacting and entraining particulates contained in the inner tube, so that particulates entrained by the high velocity flow of steam are discharged and dispersed through ports, item 59, FIG. 2, at the bottom of the outer tubes as dual, down flowing steam and particulate jets, with particulates concentrated at the outer surfaces of the jets.

A shroud, item 62, FIG. 2, between bottom ports of inner and outer tubes is provided for preservation of steam jet continuity.

Figures 3, 4:
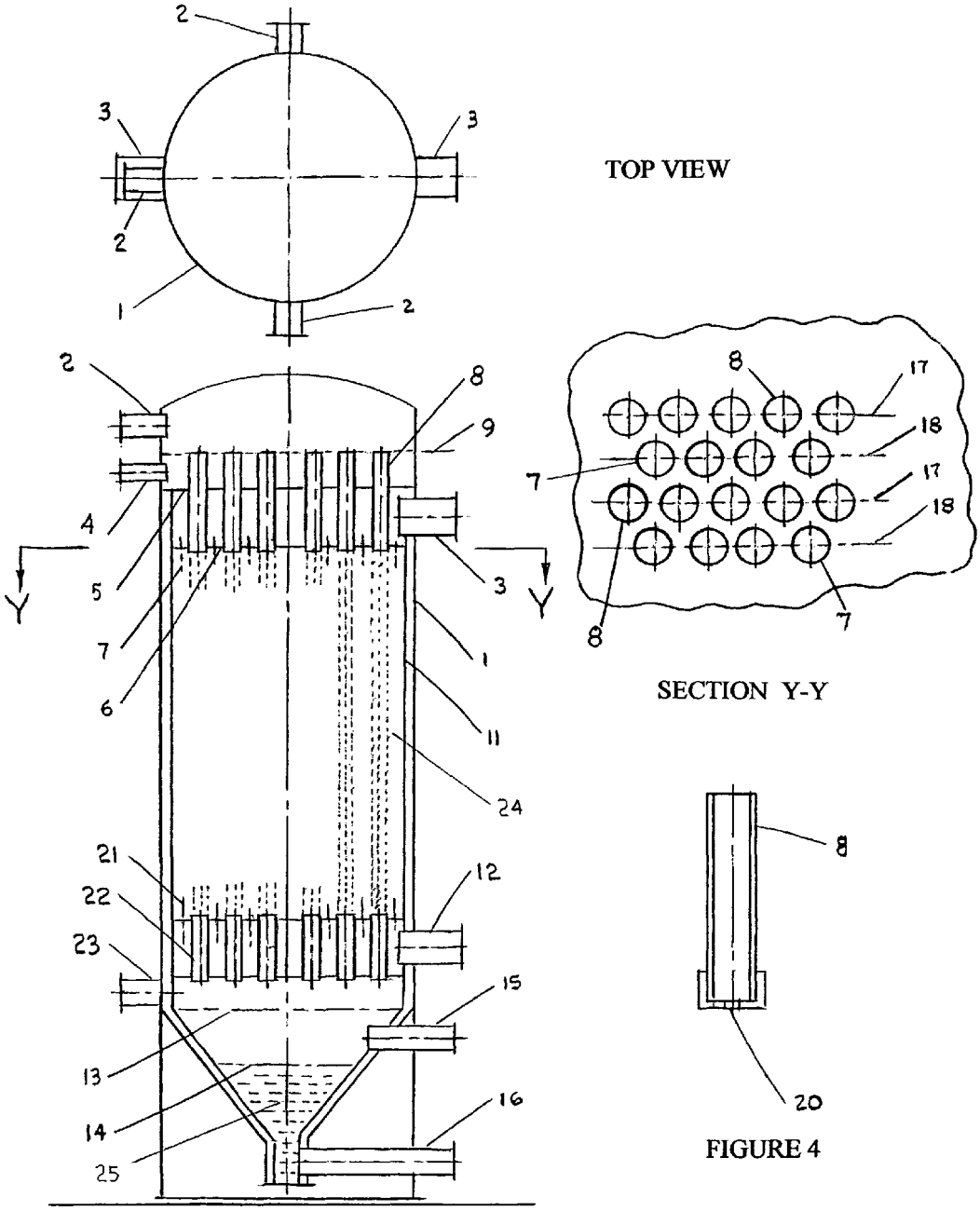

A second embodiment of the invention, a quench tower, provided only for use in the case of process liquid feed preheating, as in delayed coking, is used to cool combustion product gas containing process fluid vapor. In so doing, the process fluid vapor is condensed, recovered and combined with incoming feed. The quench tower which utilizes particulates of water as a heat and mass transfer medium, is shown in FIGS. 3 and 4, and is comprised of component parts as follows:

A vertical, cylindrical, containment vessel, item 1, internally insulated as indicated at item 11, is provided such that streams of cool liquid water particulates, directed downwards, are heated by direct contact with surrounding streams of hot combustion products, directed upwards, the particulates cooling the combustion products and condensing the process fluid vapors contained in said combustion products. Gas for dispersion of liquid water coolant enters through dispersion gas inlet nozzle, item 2. Combustion product containment vessel discharge nozzle, item 3, directs combustion products to the inlet of a conventional thermal incinerating vessel, not shown, for the purpose of ridding the combustion products of small concentrations of process fluid vapor, so that non-polluting combustion products may be discharged to atmosphere. Water coolant inlet nozzle, item 4, FIG. 3, discharges cooling water supplied by a conventional cooling tower, to an upper particulate generating module having upper and lower closure plates, items 5 and 6 respectively. A multitude of dispersion tubes, items 8, FIG. 4, passing thru the plates are arranged such that a cavity, bounded by the tops of the dispersion tubes and the top of the upper closure plate is formed, into which coolant water can enter, the cooling water overflowing the tops of the tubes, item 9, flowing downward as a film, and directed to flow horizontally, by virtue of the peripheral projection formed by the lower ports, item 20, of FIG. 4. Particulates, generated by interaction of the horizontal flow of liquid and vertical flow of dispersion gas are directed downwards and discharged through ports located at the bottom of the dispersion tubes, item 8, FIG. 4. Ports in the lower closure plate, having as centerlines, defined by items 7, in the upper module, allow up flowing combustion products to enter the cavity formed by the upper and lower plates, so as to permit exit through nozzle, item 3. Combustion product inlet nozzle, item 12, admits effluent from convection section outlet nozzle, item 52, FIG. 1, is pressurized by induced draft fan, item 64, FIG. 1, and is discharged thru outlet of said fan, for processing in quench tower, FIG. 3. Condensed process fluid vapor, the level of which is indicated by item 13, is contained in the conical bottom closure of quench tower containment vessel, item 10. Process fluid condensate exits through nozzle 15 and combines with entering process fluid feed at the inlet of pump, item 51, FIG. 1. Level of water coolant contained in conical bottom closure of quench tower containment vessel, item 1, is as indicated by item 14. Flow of water particulates and coalesced water particulates are as shown by items 24 and 25. The water coolant exits nozzle 16 for transfer to the inlet of a conventional cooling tower, followed by return for re-use as quench tower coolant.

Arrangement of tubing and combustion product gas ports, in upper and lower particulate dispersion and receiving modules, are as shown by items 17 and 18, respectively of Section Y-Y. Entering combustion product exit ports in upper plate of lower quench tower particulate receiving module are as indicated by port centerlines, items 21. Tubular particulate receiving tubes in lower module of quench tower are as shown by items 22. Dispersion gas outlet nozzle, item 23, permits recycling of dispersion gas to upper module. Lower particulate receiving module is a near but inverted duplicate of the upper particulate dispersion module, both modules having tubular and ported elements, sized and arranged identically at the apices of common equilateral triangles or quadrilaterals. The arrangement used is such as to generate a multiplicity of adjacent jets, the particulate-dispersion gas jets flowing downward and the combustion product jets flowing upward. Because the arrangement and size of jets is such that the product of the volumetric jet flow and the length to port diameter ratio of all jets is approximately the same, there is essentially the same amount of gas entrainment for each jet and the net entrainment for each jet is zero. Without entrainment, the jets do not assume a typical diverging jet profile and, in the absence of divergence, there is also an absence of horizontal jet velocity components that would otherwise result in displacement of particulates from a parallel vertical path. Without such displacement, particulates assume a very desirable vertical parallel trajectory, since with a vertical parallel trajectory, an up flowing gas stream will not bypass a down flowing particulate stream, the result being a gas-liquid contact efficiency about four times better for a quench tower designed in accordance with this invention than a spray type quench tower designed in accordance with conventional practice.

What is claimed is:

1. A direct fired process fluid heater wherein the process fluid is a liquid, and wherein heat resistant particulates are used as a heat transfer medium;

a dispersion device located at the top of the heater, the dispersion device consisting of an externally insulated outer pipe carrying pressurized steam and an inner pipe carrying a stream of particulates pressurized by a rotary helical conveyor;

one or more openings along the length of the inner pipe admitting a downward jet of steam to contact the particulates, steam jets passing through the particulate mass, and carrying with it a stream of particulates, the particulates exiting through a shrouded opening in the outer pipe;

the arrangement allowing for the formation of jets with a concentration of particulates at the outer surfaces of the jets, resulting in a cavity enveloped by the jet surfaces, the jet cavity having a base equal in diameter to the inside diameter of the heater enclosure;

permitting passage of a controlled flow of hot combustion products between inner and outer particulate containing surfaces of the jets;

use being made of an induced draft fan with control damper, located at the convection section combustion product outlet, allowing for controlled transfer of incoming combustion products from inner to outer surfaces of the jets, so as to control jet configuration and providing for maximum utilization of particulate surface area;

spacing and orientation of the steam-particulate openings to be such that contact between the down-flowing particulates and the up-flowing stream of heated combustion products, generated by horizontal, bottom, opposed, side wall burners, is obtained;

combustion product exits the burners, the combustion end of the latter extending beyond the inside wall of the heater enclosure, so that the upward flow of combustion products generated by the opposed side wall burners are directed inside the base of the cavity formed by the particulate laden surfaces of the jet;

burners to be fired with gas, liquid or other types of fuel and located at the bottom of a first vertical cylindrical, water jacketed, internally insulated particulate—combustion product containment vessel, with sloping sides, dis-engagement between combustion product and particulates occurring at the bottom of said first containment vessel, the particulates then flowing thru a particulate standpipe;

particulate free combustion product exiting at the top of said first containment vessel 1, and passing downward thru a horizontal tube convection section, the exiting combustion product processed further in a down stream quench tower;

incoming process feed, pressurized by a pump, flowing past the inside surfaces of the convection section tube array, recovering heat in the process and lowering the temperature of the combustion product gas flowing across the outer tube surfaces of the tube array;

preheated process feed exiting the convection section tube array, conveyed by a transfer line to the exit nozzle of the particulate standpipe and mixing with and conveying the high temperature particulates to a second, internally insulated, vertical containment vessel, wherein preheated process fluid is raised to design outlet temperature by contact with the high temperature particulate stream;

the up-flowing particulate and process feed stream disengaging in a reduced velocity settling section of said second containment vessel, the settling section consisting of a diametrically enlarged upper section of vessel said second containment vessel;

the high temperature liquid process stream at design temperature being further processed in downstream equipment, the particulate stream being withdrawn thru a vertical transfer line from the bottom of the settling section and entering said rotary helical conveyor which pressurizes the particulate stream, allowing particulates to be conveyed thru the dispersion device of said first containment vessel;

the combustion product streams entering the inlet of the convection section and exiting thru an outlet nozzle and transfer line and routed to a quench tower for process fluid recovery in a quench tower.

2. A quench tower for use in conjunction with the direct fired process fluid heater of claim 1, the tower consisting of a vertical cylindrical containment vessel having an external steel shell and an internal refractory lining;

an up-ward flow of combustion products, containing process fluid vapor, directly contacting a down-ward flow of water in the form of particulates, combustion products entering the containment vessel through inlet nozzles located at the bottom of the vessel and leaving at exit nozzles located at the top of the vessel, the up-flowing combustion product velocity and down-flowing flowing particulate velocity being such that minimal horizontal displacement of the down-flowing particulates is realized;

a particulate generating module located at the top of the containment vessel, consisting of a multiplicity of particulate generating tubes and combustion product gas distribution ports, tubes fixed and penetrating each of two plates, the plates forming a cavity from which combustion product gas exits, plates having a diameter equal to that of the containment vessel, the upper open ends of tubes contained between plates, located at some distance above the upper plate, the lower ends located immediately below the lower plate, the upper ends of the tubes and the upper plate forming a void space into which liquid water, entering thru a sidewall inlet nozzle, flows, water passing over and down-ward through the open ends of the tubes, assisted by a flow of dispersion gas, dispersion gas exiting the ported lower ends of the tubes in the form of particulates, particulate generating tubes and combustion product gas distribution ports, being equal in number and located at the apices of common equilateral triangles, or common quadrilaterals;

a particulate receiving and combustion product distribution module, located at the bottom of the of the containment vessel, the module a near, but inverted duplicate of the upper particulate generating module, and consisting of a multiplicity of particulate receiving tubes and exiting combustion gas ports located at the apices of common equilateral triangles or common quadrilaterals, the tubes fixed and penetrating upper and lower plates having the same inside diameter as the containment vessel, the ends of the tubes being very nearly flush with the top surface of the upper plate and bottom surface of the lower plate, upper and lower plates forming a cavity into which a side entering inlet nozzle empties, before passing through exit ports in the upper plate;

particulate generating ports in the upper module and combustion gas exit ports in the lower module having a product of port volumetric flow rate and a ratio of vertical distance between ports to port diameter that are very nearly the same.

3. A direct fired process fluid heater wherein the process fluid is a gas or vaporized liquid, and wherein heat resistant particulates are used as a heat transfer medium;

a dispersion device located at the top of the heater, effecting dispersion of the particulates, the dispersion device consisting of an externally insulated outer pipe carrying pressurized steam and an inner pipe carrying a stream of particulates pressurized by a rotary helical conveyor;

one or more openings along the length of the inner pipe permitting a downward jet of steam to contact the particulates, steam jets passing thru the particulate mass and carrying with it a stream of particulates, the particulates exiting thru a shrouded opening in the outer pipe;

the arrangement allowing for the formation of jets with a concentration of particulates at the outer surfaces of the jets, resulting in a cavity enveloped by the jet surfaces, the jet cavity having a base equal in diameter to the inside diameter of the heater enclosure;

permitting passage of a controlled flow of hot combustion products between inner and outer particulate containing surfaces of the jets;

use to be made of an induced draft fan with control damper, located at the convection section combustion product outlet, allowing for controlled transfer of incoming combustion products from inner to outer surfaces of the jets, so as to control jet configuration and allow for maximum utilization of particulate surface area;

spacing and orientation of the steam-particulate openings being such that contact between the down-flowing particulates and up-flowing stream of heated combustion products, generated by horizontal, bottom, opposed, sidewall burners is obtained;

the combustion product exit ends of the burners extending beyond the inside wall of the heater enclosure so that upward flow of the combustion products generated by the opposed side wall burners are directed inside the base of the cavity formed by the particulate laden surfaces of the jet;

burners to be fired with gas, liquid or other types of fuel and located at the bottom of a first vertical cylindrical, water jacketed, internally insulated particulate containment vessel;

dis-engagement between combustion products and particulates to be effected at the bottom of said first containment vessel, the particulates flowing thru a particulate standpipe;

particulate free combustion product exiting at the top of said first containment vessel, passing downward thru a horizontal tube convection section, exiting at the bottom of the convection section and vented;

in-coming process feed, pressurized by a fan or compressor and flowing past the inside surfaces of the convection section tube array, recovering heat in the process and lowering the temperature of the combustion product gas flowing across the outer surfaces of the tube array;

preheated process feed exiting the convection section tube array, conveyed by a transfer line to the exit nozzle of the particulates standpipe, and mixing with and conveying the high temperature particulates to a second, internally insulated containment vessel, wherein preheated process fluid is raised to design outlet temperature by contact with the high temperature particulate stream;

the up-flowing particulate and preheated process fluid stream disengaging in a reduced velocity settling section of said second containment vessel, the settling section consisting of a diametrically enlarged upper section at the top of said second containment vessel;

the high temperature gaseous process stream at design temperature being further processed in downstream equipment, the particulate stream being withdrawn thru a vertical transfer line from the bottom of the settling section and entering rotary said, helical conveyor, which pressurizes the particulate stream, allowing particulates to be conveyed thru the dispersion device of said first containment vessel.

* * * * *